US009242772B1

(12) United States Patent
Anderson et al.

(10) Patent No.: US 9,242,772 B1
(45) **Date of Patent: *Jan. 26, 2016**

(54) DRINK-THROUGH DISPENSING CAPSULE WITH SNAP IN ACTIVATION CHAMBER

(71) Applicants: Michael R. Anderson, Deerfield Beach, FL (US); Cristiana Arcangeli, San Paulo-SP (BR)

(72) Inventors: Michael R. Anderson, Deerfield Beach, FL (US); Cristiana Arcangeli, San Paulo-SP (BR)

( * ) Notice: Subject to any disclaimer, the term of this patent is extended or adjusted under 35 U.S.C. 154(b) by 244 days.

This patent is subject to a terminal disclaimer.

(21) Appl. No.: 13/849,251

(22) Filed: Mar. 22, 2013

Related U.S. Application Data

(63) Continuation-in-part of application No. 13/752,493, filed on Jan. 29, 2013, now Pat. No. 8,960,424, which is a continuation-in-part of application No. 13/478,419, filed on May 23, 2012, now Pat. No. 9,132,950, said application No. 13/752,493 is a continuation-in-part of application No. 13/480,958, filed on May 25, 2012, now Pat. No. 8,839,982.

(60) Provisional application No. 61/490,971, filed on May 27, 2011, provisional application No. 61/490,920, filed on May 27, 2011.

(51) Int. Cl.
*B65D 81/32* (2006.01)
*B65D 51/22* (2006.01)
*B65D 25/08* (2006.01)

(52) U.S. Cl.
CPC ..... *B65D 51/224* (2013.01); *B65D 25/08* (2013.01)

(58) Field of Classification Search
CPC ..... B65D 81/32; B65D 81/3211; B65D 81/3205; B65D 81/3255; B65D 51/28; B65D 51/2814; B01F 13/005; A61J 1/2096; B67B 7/24
USPC ..... 206/222, 219, 220; 215/DIG. 8, 227; 220/521; 222/83; 141/329
See application file for complete search history.

(56) References Cited

U.S. PATENT DOCUMENTS

| | | | | |
|---|---|---|---|---|
| 3,156,369 | A | | 11/1964 | Bowes et al. |
| 3,220,588 | A | * | 11/1965 | Lipari ..... 206/222 |
| 3,347,410 | A | * | 10/1967 | Schwartzman ..... 222/80 |
| 3,521,745 | A | * | 7/1970 | Schwartzman ..... 206/222 |
| 3,840,136 | A | | 10/1974 | Lanfranconi et al. |
| 3,924,741 | A | | 12/1975 | Kachur et al. |
| 5,029,718 | A | | 7/1991 | Rizzardi |
| 5,542,528 | A | * | 8/1996 | Lanfranconi et al. ..... 206/221 |

(Continued)

*Primary Examiner* — Steven A. Reynolds
(74) *Attorney, Agent, or Firm* — Malin Haley DiMaggio & Bowen, P.A.

(57) ABSTRACT

A container cap having a dispensing capsule for mixing ingredients at the time of use to extend shelf life. The device involves having a cap body having an internal passage; a chamber removably snapped into the internal passage of the cap body, the chamber including a flexible actuator and a sealing member sealing a lower portion of the chamber; a drinking spout slidingly engaged with a top portion of the flexible actuator of the chamber; a hollow plunger slidingly disposed within the chamber. The hollow plunger engages the flexible actuator of the chamber and the flexible actuator is configured to deform and engage the hollow plunger, causing the hollow plunger to puncture the frangible sealing member, dispensing an ingredient stored in the chamber. A resilient seal is inside the flexible actuator and a piercing member in the drinking spout is configured to puncture said resilient seal when the drinking spout is engaged downward. A drink-through channel is prescribed from the chamber through to the spout.

10 Claims, 6 Drawing Sheets

(56) References Cited

U.S. PATENT DOCUMENTS

| | | | | |
|---|---|---|---|---|
| 5,593,028 | A | 1/1997 | Haber et al. | |
| 5,782,345 | A * | 7/1998 | Guasch et al. | 206/222 |
| 5,839,573 | A * | 11/1998 | Morini | 206/221 |
| 6,003,728 | A * | 12/1999 | Elliott | 222/81 |
| 6,148,996 | A | 11/2000 | Morini | |
| 6,230,884 | B1 * | 5/2001 | Coory | 206/222 |
| 6,305,576 | B1 * | 10/2001 | Leoncavallo | 222/83.5 |
| 6,435,341 | B1 * | 8/2002 | Nobbio | 206/219 |
| 6,874,664 | B1 * | 4/2005 | Montgomery | 222/525 |
| 7,178,683 | B2 | 2/2007 | Birkmayer et al. | |
| 7,568,576 | B2 | 8/2009 | Sweeney, Jr. et al. | |
| 7,870,952 | B2 | 1/2011 | Fontana | |
| 7,882,976 | B1 * | 2/2011 | Goede | 220/258.1 |
| 7,900,787 | B2 * | 3/2011 | Oh et al. | 215/6 |
| 7,951,109 | B2 | 5/2011 | Anderson | |
| 8,215,481 | B1 * | 7/2012 | Knickerbocker | 206/222 |
| 8,356,711 | B2 * | 1/2013 | Canziani Hoffa et al. | 206/222 |
| 8,701,906 | B1 * | 4/2014 | Anderson | 215/227 |
| 2003/0213709 | A1 | 11/2003 | Gibler et al. | |
| 2005/0007870 | A1 | 1/2005 | Faraldi et al. | |
| 2008/0142473 | A1 | 6/2008 | Cho | |
| 2008/0202950 | A1 | 8/2008 | Anderson | |
| 2008/0245683 | A1 * | 10/2008 | McKenna et al. | 206/219 |
| 2009/0308831 | A1 * | 12/2009 | Anderson | 215/227 |
| 2010/0059394 | A1 * | 3/2010 | Fontana | 206/222 |
| 2010/0163442 | A1 * | 7/2010 | Lee et al. | 206/222 |
| 2010/0163509 | A1 * | 7/2010 | Canziani Hoffa et al. | 215/228 |
| 2010/0187257 | A1 | 7/2010 | Roth et al. | |
| 2010/0236952 | A1 * | 9/2010 | Masterson et al. | 206/222 |
| 2010/0237075 | A1 * | 9/2010 | Wilhelm | 220/284 |
| 2011/0174642 | A1 * | 7/2011 | Coon | 206/222 |
| 2011/0266171 | A1 | 11/2011 | Rovelli | |
| 2012/0193362 | A1 | 8/2012 | Porter | |
| 2015/0034673 | A1 * | 2/2015 | Hopkins et al. | 222/129 |

* cited by examiner

DRINK-THROUGH DISPENSING CAPSULE WITH SNAP IN ACTIVATION CHAMBER

CROSS REFERENCE TO RELATED APPLICATIONS

This application is a continuation-in-part of co-pending U.S. patent application Ser. No. 13/752,493 filed Jan. 29, 2013, which is a continuation-in-part of co-pending U.S. patent application Ser. No. 13/478,419 filed May 23, 2012, which claims priority to U.S. Provisional Patent Application Ser. No. 61/490,971 filed May 27, 2011, and co-pending U.S. patent application Ser. No. 13/480,958 filed May 25, 2012, which claims priority to U.S. Provisional Patent Application Ser. No. 61/490,920 filed on May 27, 2011.

STATEMENT REGARDING FEDERALLY SPONSORED RESEARCH OR DEVELOPMENT

N/A

BACKGROUND OF THE INVENTION

1. Field of the Invention

The present invention generally relates generally to dosing caps and container caps having dispensing capsules for various ingredients for mixing at the time of use and more particularly to a chambered dispensing capsule having a snap in activation chamber including a drink-through actuator for use on a variety of containers and in conjunction with a variety of ingredients.

2. Description of Related Art

Most if not all liquids, creams, gels and even certain powders and other substances are formulated and created for the longest shelf life and not necessarily for optimal performance and/or usefulness. There are many ingredients and/or combinations of ingredients that have reduced shelf life due to requiring combinations of liquid substances. In most all cases when any ingredients are exposed to one another, including air, deterioration begins and the clock on the limited shelf life starts. Also in most products in any category, "Shelf Life" is the key factor with respect to expiration dates based on the product and category.

Several attempts have been made to design ingredient containing capsules and containers to improve the shelf lives of compositions such as gels, liquids, powders and the like; however, the majority of the available devices rely on a plurality of interconnected parts of the same ingredients which are not always effective in operation of the device The present invention is designed to be inexpensive to mass produce, fill and seal to be able to deliver an affordable dispensing capsule that attaches to a container in virtually any application and category. This invention allows formulas and new products in any categories to be invented and made for desired end effects and not for what has to be done due to normal packaging and manufacturing and eliminating many unhealthy ingredients that are currently and normally used to produce most products. The present invention, therefore, is useful for packaging ingredients such as enzymes, calcium and magnesium with bio flavinoids, vitamin C, probiotics creatine and many more.

Many dosing caps are manually difficult to activate due to the manual force required to operate. Moreover, most of the dispensing capsules in the prior art comprise molded unibody rigid designs using a single material of uniform ingredients that increase manufacturing costs and can be somewhat difficult to activate due to the need for a rigid material to engage a container without breaking or disassembling. The use of these rigid materials can render certain dispensing actuators difficult to depress or use because of the single-material design. Accordingly, the present invention solves this problem and is particularly useful because the dosing caps described herein includes a snap in activation chamber that is configured to engage a cap body wherein the cap body and the dosing chamber can comprise different materials in order to improve manufacturing, storing, and utility capabilities of the invention. Further, the present invention provides a container cap having a dispensing capsule that includes having a drink-through spout, improving the convenience and usability of the present invention. These and other improvements described below also provide a substantial improvement over the prior art with respect to shelf life and overall versatility.

It is, therefore, to the effective resolution of the aforementioned problems and shortcomings of the prior art that the present invention is directed. However, in view of the container and dispensing capsules and related devices in existence at the time of the present invention, it was not obvious to those persons of ordinary skill in the pertinent art as to how the identified needs could be fulfilled in an advantageous manner.

SUMMARY OF THE INVENTION

The present invention comprises various embodiments of a dosing cap and container cap having an ingredient dispensing capsule. In some embodiments, the dispensing capsule comprises a container cap body having an internal passage; a chamber removably snapped into the internal passage of the cap body, the ingredient chamber including a flexible dispensing actuator and a sealing member sealing a lower portion of the chamber; a drinking spout slidingly engaged with a top portion of the flexible actuator of the chamber; a hollow plunger slidingly disposed within the chamber, wherein a top portion of the hollow plunger engages the flexible actuator of the chamber; and wherein the flexible actuator is configured to deform and engage the hollow plunger, causing a distal end of the hollow plunger to puncture the sealing member, dispensing an ingredient stored in the chamber into the container at the time of use mixing the ingredients in the container with the ingredients in the dosing cap.

The invention further includes a resilient frangible seal inside a top portion of the flexible actuator wherein a piercing member in the drinking spout is configured to puncture said frangible resilient seal when the drinking spout is engaged downward. The drinking spout is configured to engage the flexible actuator when the device is to be activated. This allows the mixed ingredient in the container to flow through the container cap after the cap has been activated.

The container cap body includes internal threads configured to threadably engage a container spout or opening wherein the container can contain a second ingredient that is mixed with the ingredient stored in the chamber of the dispensing capsule. A pass-through drinking channel is delimited from the dispensing chamber through to the drinking spout to allow for drinking and/or access to the contents of the container after the container cap having the dispensing capsule has been activated. The drinking spout can be opened or closed manually as desired after activation for selective access to the contents of the container.

The chamber includes two circumferentially disposed races defining an outside annular groove, wherein an inside annular protrusion in the internal passage of the cap body engages the annular groove of the chamber in a form snap in that once engaged is not separable or removable. The dosing cap chamber is comprised of a softer material than the container cap body allowing for reduced manual force for pushing down on the dispensing actuator to dispensing the dosing cap ingredients into the container.

The ingredients dispensing flexible actuator comprises a bellow-type or step-type actuator. The hollow plunger includes at a nozzle portion at the top as well as one or more aeration openings. The bottom of the plunger includes a beveled cutting surface for piercing the sealing member.

Accordingly, it is an object of the present invention to provide a container cap having a dispensing capsule that comprises a snap-in chamber, allowing for differences in material hardness with respect to the chamber and the cap body, in order to reduce manual force required for activation of the capsule while dispensing the ingredients.

It is another object of the present invention to provide a container cap having a versatile dispensing capsule that can be used in conjunction with a plurality of containers and dispense an ingredient contained therein in an easy and efficient manner.

It is another object of the present invention to provide a dispensing capsule with a drink-through drinking spout, further enhancing the usability and convenience of the invention.

In accordance with these and other objects which will become apparent hereinafter, the instant invention will now be described with particular reference to the accompanying drawings.

DETAILED DESCRIPTION

Figure 1:
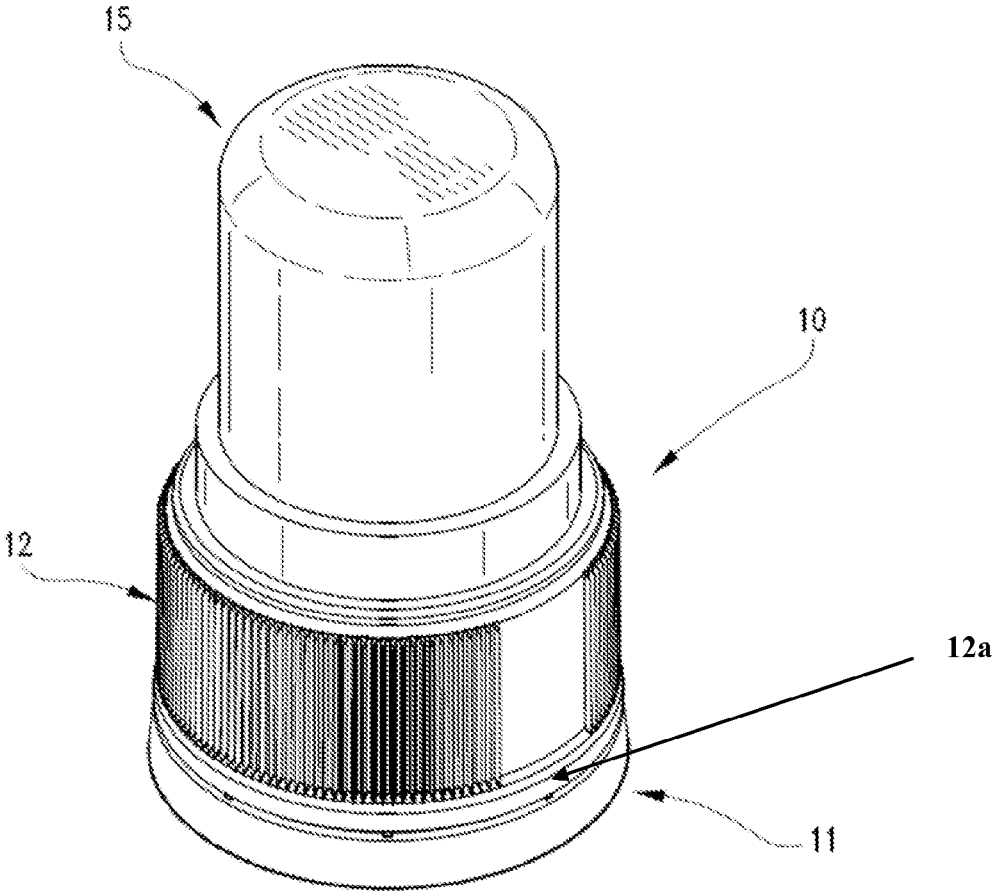
FIG. 1 is a perspective view of one embodiment of the dispensing capsule of the present invention in an assembled state.

FIG. 1 shows the container cap having a dispensing capsule 10, a removable dust cover 15, a container cap gripping area 12 and a safety band 12*a* to prevent removal of the capsule 10 from the container.

With reference to FIGS. 2-6, the container cap having a dispensing capsule generally comprises a container cap body 10 that screws on to a container 50 (FIG. 4), said cap body 10 having an internal passage 11, a snap-in ingredient activating chamber 20 having received therein a slidingly disposed plunger 21, and a sealing member 30. The cap body 10 includes a manual gripping area 12 on the outside thereof and internal threads 13 within the internal passage 11 thereof. The internal threads 13 are adapted to threadingly engage a container, such as a bottle, intervenous (IV) bag, or the like as further shown and described as container 40. Also provided within the internal passage 11 of cap body 10 are one or more annular protrusions 14 which are provided around the internal circumference of the cap body. A single annular protrusion 14 is provided and is configured to engage the snap-in chamber 20 as further described. Also provided over the top portion of the cap body 10 is a dust cover 15 which may be hingeably attached to cap body 10 by hinge or other similar structure allowing the cover 15 to be retained on the cap body 10 but also be selectively opened and closed by the user to access the snap-in chamber.

Figure 2:
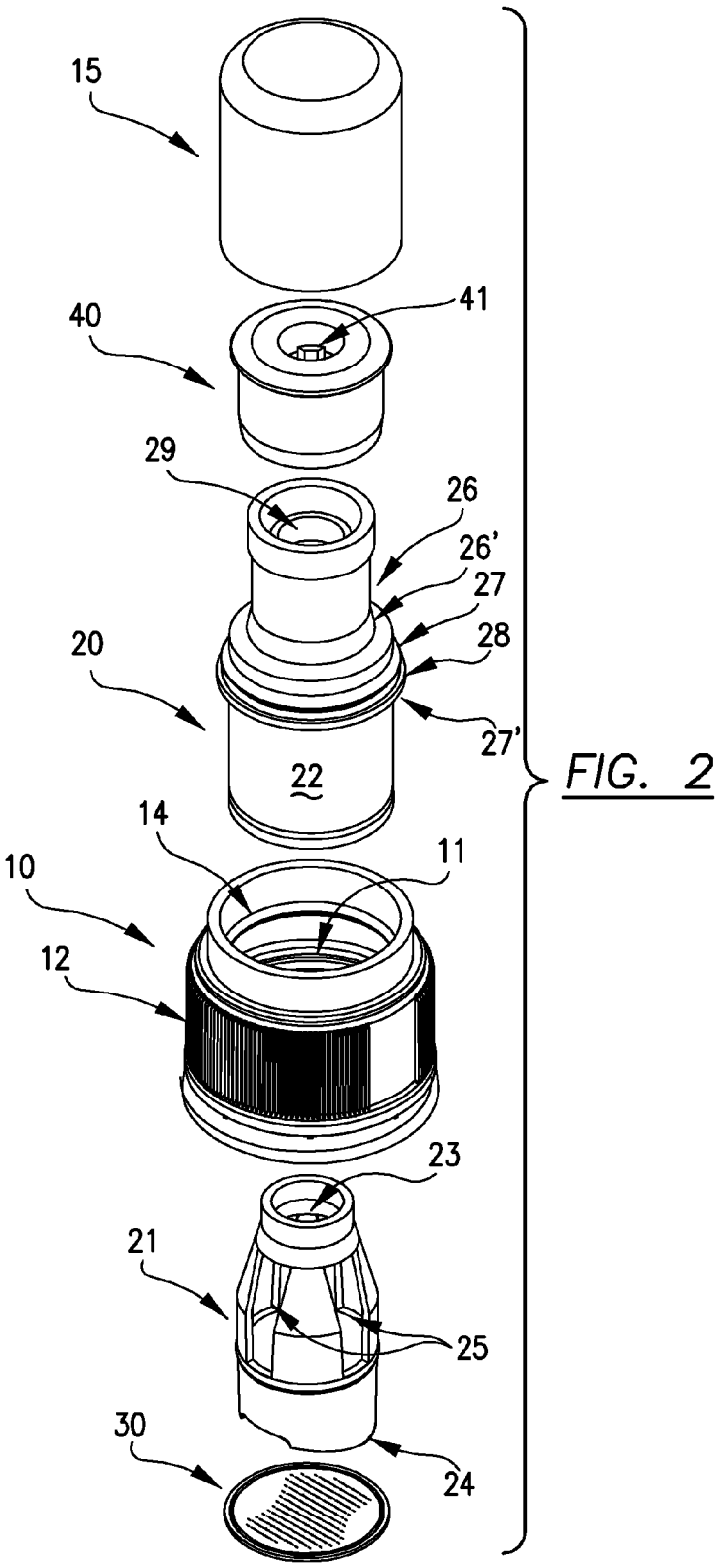
FIG. 2 is an exploded view of one embodiment of the dispensing capsule of the present invention depicting the various components thereof.
Figure 3:
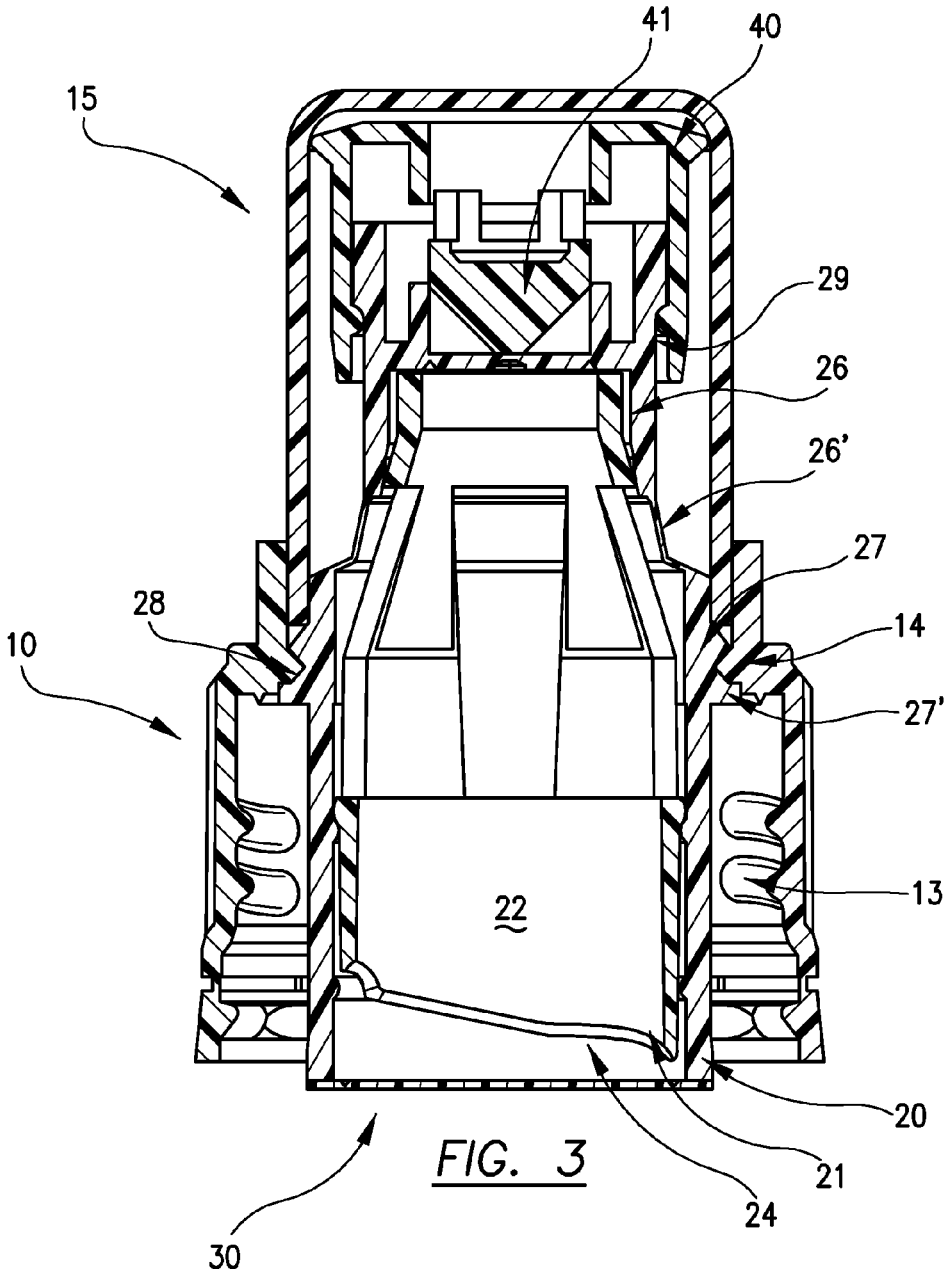
FIG. 3 is a side elevational cross-sectional view of one embodiment of the present invention in an assembled state.

Shown best in FIG. 2, the snap-in chamber 20 comprises a hollow ingredient storage compartment 22 that is configured to slidingly receive plunger 21. Plunger 21 is hollow and includes an upper nozzle 23 and a lower cutting surface 24 which, in some embodiments, is defined by an angling or beveling of the distal end of the plunger 21. The nozzle 23, comprises a tapered protrusion configured to engage the inside of the snap-in chamber 20. The upper portion of the plunger 21 may, include one or more aeration openings 25 which prevent the trapping of air inside the chamber 20 during operation.

The top portion of the snap-in chamber 20 comprises a flexible actuator 26 which includes a flexible portion 26' step shaped comprised of a rubber, plastic, or combinations thereof and other like materials. The inside of the top portion of actuator 26 includes a frangible seal 29. Plunger 21 is configured such that it is accommodated by the matching internal dimensions and configuration of the storage compartment 22 of snap-in chamber 20, including the nozzle 23. The top portion of the plunger 21 including nozzle 23 thereof extends into the snap-in chamber 20 such that the top of the plungers 21 is adjacent underside of the flexible actuator 26.

A drink spout 40 is provided which slidingly engages the upper portion of the flexible actuator 26. Spout 40 is at least partially hollow and includes a piercing member 41 which may comprise one or more protrusions extending downwardly toward actuator 26 of chamber 20. The spout 40 is configured to reciprocate up and down along actuator 26 to provide selective open/closed drink-though capability as described further below.

Figure 6:
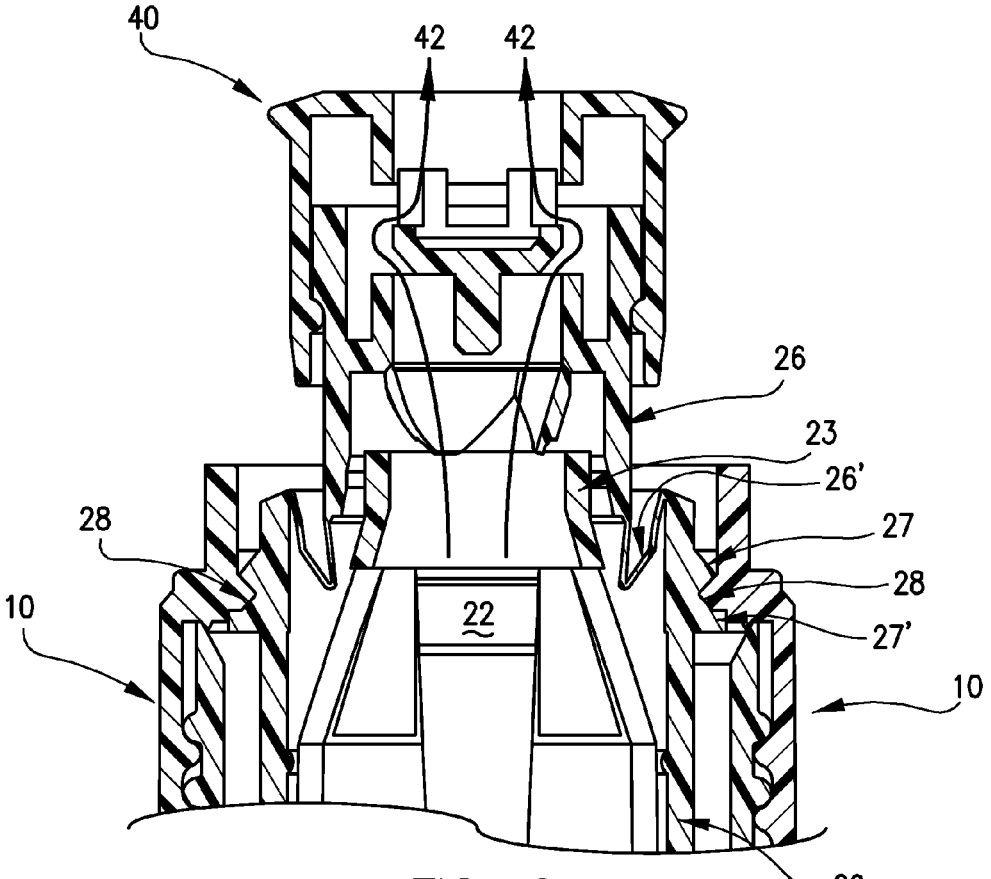
FIG. 6 is yet another side elevational cross-section view of one embodiment of the present invention, shown with a drink-through feature with the drink through passage open.

As noted above, a lower cutting surface 24 of plunger 21 is comprised of an angle-cut configuration in order to provide an edge to break or pierce the sealing member 30 during activation of the device as shown in FIG. 6. Accordingly, the sealing member 30 is attached around a bottom portion of the chamber 20, at the bottom periphery thereof. With resilient seal 29 at the top of the actuator 26 portion of chamber 20 and the frangible sealing member 30 at the bottom of chamber 20, the storage compartment 22 of chamber 20 is sealed in order to contain one or more ingredients therein until the device is actuated. Further, because plunger 21 is initially disposed completely within storage compartment 22 of the chamber 21, the resilient seal 29 and sealing member 30 also seals plunger 21 therein.

As shown in FIG. 2 and FIGS. 4-6, disposed towards the upper portion of the snap-in chamber 20 are two circumferentially disposed protrusions races 27 and 27' which define a hollow annular groove 28 circumferentially disposed around the chamber 20. Accordingly, snap-in chamber 20 is configured to be removably received inside cap body 10 whereby the annular protrusion 14 of the cap body engages and snaps into annular groove 28. This two piece construction provides for easier manufacturing of the present invention and also permits the snap-in chamber 20, including the flexible actuator 26 to be comprised of a relatively less rigid resilient softer material as compared to the cap body 10. This allows the cap body 10 to be more durable and rigid when engaging a container such as bottle, while also improving the ease of which the relatively softer button actuator (less manual force) is activated. Thus, no compromise between structural rigidity and ease-of-use has to be made with a snap-in actuator of a different material.

Figure 4:
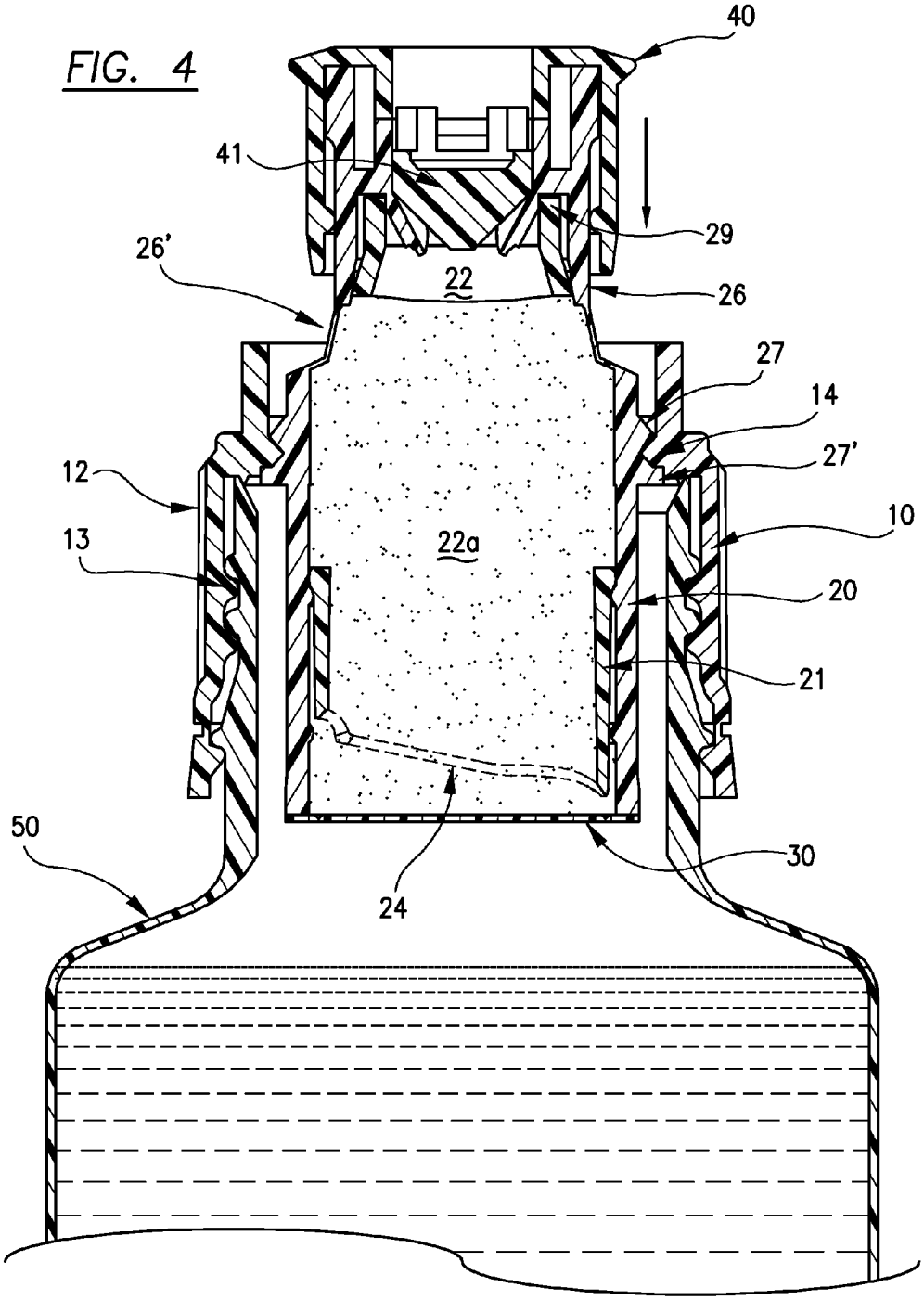
FIG. 4 is another side elevational cross-sectional view of one embodiment of the present invention attached to a container un-activated.

With reference to FIG. 4, the dispensing capsule of the present invention is configured to store a first ingredient 22*a* within the storage compartment 22 of snap-in chamber 20, which chamber is initially sealed at the bottom by frangible sealing member 30 and with hollow plunger 21 also disposed within snap-in chamber 20. The snap-in chamber is snapped into the cap body 10 during manufacturing which cap body 10 may be screwed onto or otherwise provided onto a container 50 whereby, the cap body 10 threadably engages the container 50 by way of internal threads 13. In other embodiments, the cap body 10 may engage container 50 by a snap fitment or other structure. With the cap body 10 attached to a container 50, at least a portion of the chamber 20 will be disposed down into the container, or a neck portion thereof.

Figure 5:
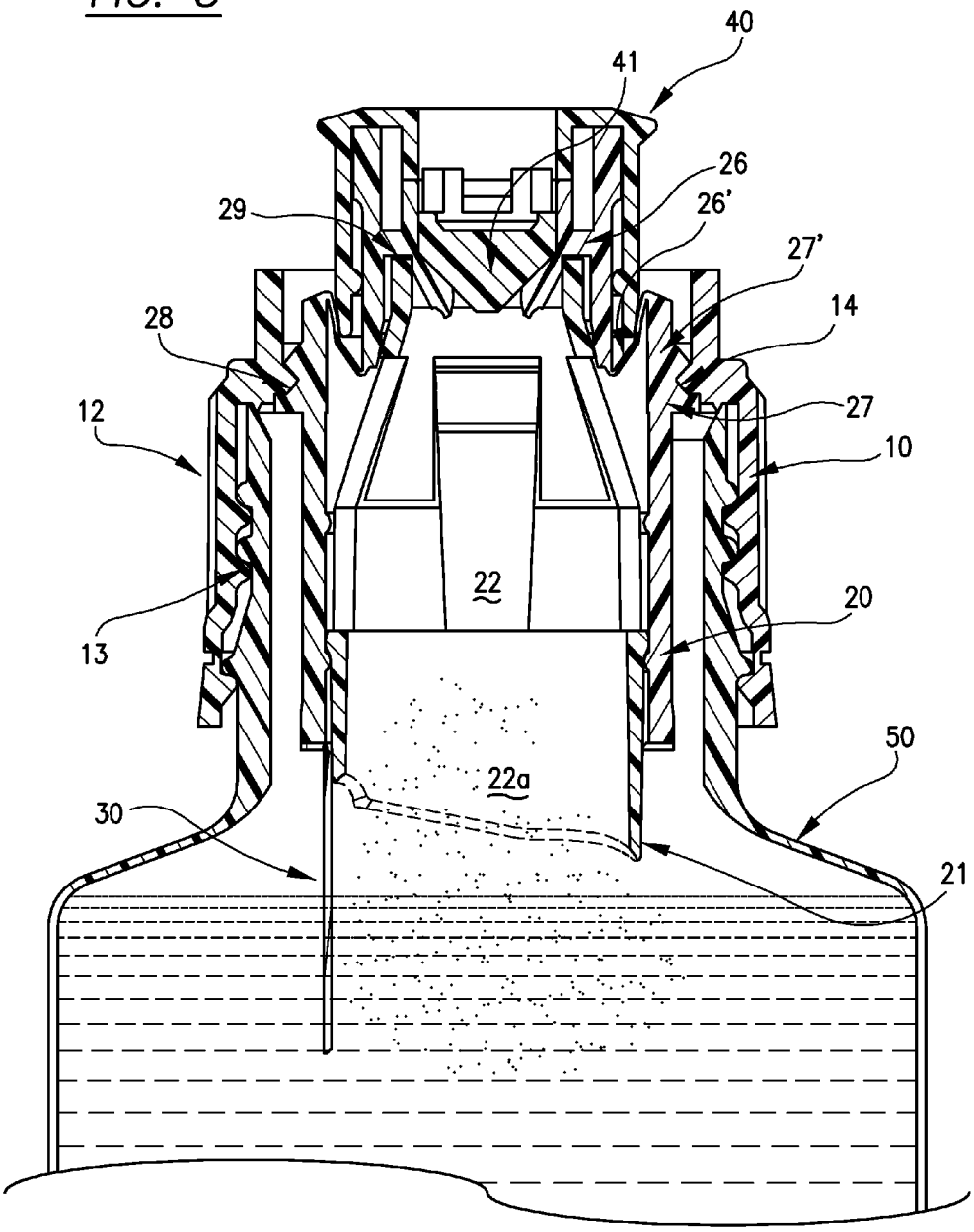
FIG. 5 is another side elevational cross-sectional view of one embodiment of the present invention attached to a container after being activated.

With reference to FIGS. 4-6, the capsule is configured to selectively dispense the first ingredient 22*a* from the chamber 20 by manually depressing the drink spout 40 in a downward direction. This downward action causes the piercing member 41 to at least partially break frangible seal 29. The user continues to apply downward pressure on spout 40 which will engage the flexible actuator 26 causing the flexible actuator 26 to also begin moving in a downward fashion. As the actuator 26 deforms and travels downward (compare FIGS. 4, 5, and 6), the inside of actuator 26 engages and applies downward pressure onto the top portion of hollow plunger 21, at the nozzle 23. The continued downward force causes plunger 21 to displace downwardly at least until the lower cutting surface 24 of plunger 21 breaks or punctures sealing member 30. Once the sealing member 30 is broken, the first ingredient 22*a* will be dispensed from chamber 20 by gravity.

The device is attached to a container 50 and therefore the first ingredient 22*a* will dispense downward into the container to, for example, be mixed with another ingredient contained in the container. The hollow plunger 21 is resiliently retained within the storage chamber 20 to prevent the hollow plunger 21 from dislodging from the dispensing capsule during operation. It is further appreciated that in the case of a bellow (accordion like) step-type shaped actuator 26, the actuator may resiliently return to its starting position after activation.

With reference to FIG. 6, shown is the drink-through capability of the present invention. With the dispensing capsule activated in accordance with the above description, frangible seal 29 and frangible sealing member 30 are both at least partially broken or punctured. Accordingly, a drink-through or pass-through channel 42 is created from the storage space 22 of chamber 20, through to the drinking spout 40. This allows the user to access the contents of container 50 after the dosing cap has dispensed a first ingredient 22*a* into the container 50. This provides added functionality and convenience for the user. Furthermore, the drinking spout 40 can be reciprocated up and down such that the drink-through channel 42 can be opened and closed on demand, much like a sports bottle or the like. The opening and closing is controlled by the interface between piercing member 41 and resilient seal 29. Accordingly frangible resilient seal 29 does not completely breakaway from the chamber 20 but rather remains partially intact to form at least a partial seal when the drinking spout 40 is in the "up" or "closed" position.

It is appreciated that the closing cap of the present invention can comprise any combination of materials including plastics, rubbers, aluminum, resins, and the like. With this, as noted above, in some embodiments it is desirable for the cap body 10 to be comprised of a comparably harder material than that of the snap-in chamber 20 and its constituent components. This provides a rigid engagement of the cap body with a container while also improving the ease of which the actuator 26 can be activated by a user. To that end, because the cap body 10 is hard in certain embodiments, the softer snap-in chamber 20 and its actuator 26 will take less force manually to activate because the actuator has a more rigid supporting, non-moving piece to engage against, i.e. the cap body 10. The device may also be sized and shaped to accommodate fitment on any desired container 50 such as bottles, IV bags, pouches, and the like. Furthermore, the threaded engagement with the container may be substitute for various snap-on or other releasable fitments known in the art.

It is further appreciated that the frangible seal 29 and frangible sealing member 30 may comprise a variety of plastic and foil-like materials. In some embodiments, seal 29 and sealing member 30 comprise a thin plastic or resin material having one or more lines of weakening to allow for dispensing of the first ingredient. In other embodiments, the seal 29 and sealing member 30 may comprise a foil or paper material equally suitable to be broken by the plunger and piercing action described above. In some embodiments, the seal 29 and sealing member 30 are discrete components that are heat sealed, glued, or otherwise attached to the snap-in chamber 20. In other embodiments, the seal 29 and sealing member 30 are coextensively integrated into the chamber 20 but otherwise include lines of weakening or comprise a thin enough or breakable enough material such that the seal breaks under the force of piercing member 41 and/or lower cutting surface 24 at the bottom of the plunger.

It is appreciated that the storage compartment 22 of the chamber 20 can contain any liquid, powder and or gasses and or micro/nano encapsulation in any combination desired. The dispensing capsule can be mounted or applied at any location of a container 50 including a bottle, pouch, can, IV bag, drum or tote. In some embodiments, the capsule is suited to be received on the threaded opening of such containers in order to provide a leak-free fitment. The chamber 20 of the dispensing capsule stores any desired ingredient and the capsule and the cap body may be dimensioned as desired to fit a variety of applications. The size and shape of the capsule of the present invention should not be construed as limited to the sizes and shapes shown in the drawings herein. Rather, the volume of the chamber and the diameter of the various components can vary as desired and/or can vary depending on the size and shape of the intended container or other parameters. Further, the chamber need not be filled completely, but rather can accept any volume of an ingredient desired depending on mixing parameters and the desired final product.

By way of example only, the device can be used for drinks, hair care, pet products, drugs, over the counter medications, cleaning products, beverages, soups, dressings, nitrogen, fuels and engine cleansing, oils, waxes, pH enhancers, oral care, oxygen, adhesives and other categories of use depending on the ingredients and formulas. It is appreciated that the dispensing capsule allows for on-demand dispensing at the time of use mixing of a product or component of a product for mixing with another ingredient or ingredients in the container to which it is attached. It also provides a device to access or drink directly from the container 50 without needing to remove the container cap first. Also a coating of any type of moisture absorbent material can be applied to the inside of the chamber to act as a desiccant and allow for moisture absorption of any excess moisture that may be contained inside the invention when filled and sealed.

Due to the encapsulated capsule excluding the sealing area, the invention allows the ingredients to remain moisture free and have an unusually long shelf life and allowing with the sealed chamber to combine liquids and powders and oils and other ingredients to be sealed and stored separately if desired to prevent any reaction with one another. Also the device can include multiple applicators such as drinking spouts, pouring spouts and removable dosing cap for use of a product with one or more multiple chambers and plungers that have flow through to allow dispersing of all ingredients into a desired container. The exact configuration of such spouts and applications is not limited only to those designs shown in figures herein.

The instant invention has been shown and described herein in what is considered to be the most practical and preferred embodiments. It is recognized, however, that departures may be made therefrom within the scope of the invention and that obvious modifications will occur to a person skilled in the art.

What is claimed is:

1. A container cap having an ingredient dispensing capsule, comprising:

a container cap body having an internal passage;

a removable chamber snapped into said internal passage of said cap body, said chamber including a flexible actuator and a frangible sealing member sealing a lower portion of said chamber;

a drinking spout slidingly engaged with a top portion of said flexible actuator of said chamber;

a hollow plunger slidingly disposed within said chamber, wherein a top portion of said hollow plunger engages said flexible actuator of said chamber, said hollow plunger including at said top portion thereof, a nozzle comprising a tapered protrusion configured to engage an inside aspect of said chamber, said hollow plunger further comprising a plurality of aeration openings at said top portion;

a frangible seal inside a top portion of said flexible actuator wherein a piercing member in said drinking spout is configured to puncture said frangible seal when said drinking spout is engaged downward;

wherein said flexible actuator is configured to deform and engage said hollow plunger, causing a distal end of said hollow plunger to puncture said sealing member, dispensing an ingredient stored in said chamber.

2. The dispensing capsule of claim 1 wherein said drinking spout is configured to engage said flexible actuator.

3. The dispensing capsule of claim 1, further comprising a drink-through channel from said chamber through to said drinking spout.

4. The dispensing capsule of claim 1, wherein said cap body includes internal threads configured to threadably engage a container.

5. The dispensing capsule of claim 1, wherein said flexible actuator comprises a bellow-type actuator.

6. The dispensing capsule of claim 1, further include a dust cover removably received on said cap body over said drinking spout.

7. The dispensing capsule of claim 1, wherein said chamber includes two circumferentially disposed races defining an annular groove, wherein an annular protrusion in said internal recess of said cap body removably engages said annular groove of said chamber.

8. The dispensing capsule of claim 1, wherein said chamber is comprised of a softer material than said cap body.

9. The dispensing capsule of claim 1, wherein said material of said chamber and said cap body is plastic.

10. The dispensing capsule of claim 1, wherein said distal end of said hollow plunger comprises a beveled cutting surface.

* * * * *